US006215391B1

(12) United States Patent
Murray et al.

(10) Patent No.: US 6,215,391 B1
(45) Date of Patent: Apr. 10, 2001

(54) VARIABLE FREQUENCY BUZZER ASSEMBLY

(75) Inventors: Matthew J. Murray, Sanford; Ronald J. Johnsen, Cary, both of NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/420,735

(22) Filed: Oct. 22, 1999

(51) Int. Cl.[7] ..... G08B 3/00

(52) U.S. Cl. ..... 340/388.1; 340/388.4; 340/391.1

(58) Field of Search ..... 340/388.1, 388.4, 340/391.1, 311, 1, 825.44; 455/226.4, 347; 379/217, 374, 375, 440; 333/219, 227, 231, 232, 233; 381/345, 351; 181/198; 310/321–324

(56) References Cited

U.S. PATENT DOCUMENTS 4,413,253 * 11/1983 Hofer et al. ..... 340/388.4
4,728,933 * 3/1988 Mazza ..... 340/391.1
5,953,408 * 9/1999 Blanvillain et al. ..... 379/374
6,075,998 * 6/2000 Morishima ..... 455/567

FOREIGN PATENT DOCUMENTS

86292 * 7/1979 (JP) .
75578 * 3/1994 (JP) .

* cited by examiner

*Primary Examiner*—Thomas Mullen
(74) *Attorney, Agent, or Firm*—Coats & Bennett, PLLC

(57) ABSTRACT

A buzzer assembly for a personal communications device changes geometry in order to emit sounds at a variety of frequencies at an approximately constant volume, such as for playing melodic alerts. The buzzer assembly incorporates a buzzer and gasket to create an air chamber with an associated acoustic impedance. A translational actuator moves a portion of either the buzzer or gasket, depending on the particular embodiment, to change the air volume and thus the associated acoustic impedance. By changing the acoustic impedance, the resonant frequency of the buzzer assembly is changed. When the buzzer is then operated at or near resonant frequency corresponding to the then-current acoustic impedance, the sound generated by the buzzer assembly is louder. By changing the resonant frequency of the buzzer assembly in this manner to correspond to the frequency of the tone to be generated, the sound volume generated by the buzzer assembly can be made approximately constant across a broader frequency range than is possible with conventional buzzer designs, such as 3 kHz or larger.

24 Claims, 7 Drawing Sheets

VARIABLE FREQUENCY BUZZER ASSEMBLY

BACKGROUND OF THE INVENTION

This invention is directed to a buzzer assembly for use in a personal communications device which changes geometry in order to emit sounds at a variety of frequencies at an approximately constant volume, such as for playing melodic alerts.

Personal communications devices, such as cellular phones or pagers, typically have a number of components which help to alert the user to various conditions. For instance, an alert may be generated in response to an incoming call or page. The most common alert generating components are vibrators and buzzers, of which buzzers are of interest for the present invention.

Typically, buzzers resonate at a ring frequency around three kilohertz, producing a simple monotone alert sound or a dual tone of closely spaced frequencies. Problems arise when, instead of a simple monotone, users desire alert sounds to be other than monotone or tightly spaced dual tone, such as a melody that varies frequency over the range from about 1 kHz to about 4 kHz. Typically, buzzers are configured for optimum audio output at a particular frequency (the "ring frequency"). When such a buzzer is used at other frequencies, the buzzer output volume drops off significantly, even at frequencies as close as 200 Hz away from the ring frequency. This results in an unrecognizable melody with significant disparities in volume while the "melody" is played. This variability in loudness reduces the perceived quality, can be annoying to the user, and may result in missed calls.

The immediately apparent solution of using a larger buzzer capable of generating sufficient volume at different frequencies is not practical due to the extreme space constraint pressures present in today's world of ever shrinking personal communications devices.

It is known in the art to combine a vibrator, speaker and buzzer into one unit, called a multi-mode actuator. While such multi-mode actuators can be used to play melodies, they suffer from a serious drawback. The output from the multi-mode actuator in speaker mode should be directed into the user's ear for optimum performance. However, because the audio volume in call alert mode is much higher than in speaker mode, the output of the multi-mode actuator should not be directed into the user's ear. Thus, the optimum output routing configuration for the multi-mode actuator is different for its different functions, thereby defeating its combinational advantage. As such, it is common to use a separate buzzer whose output is typically vented perpendicular to the plane of the speaker that is used to output audio signals from the personal communications device. In this manner, the output from the buzzer is not directed into the user's ear in the event a user places the device against their ear immediately prior to an alert. However, due to existing buzzers' inherent output audio volume variation over frequency, as mentioned above, existing buzzers perform poorly when asked to play melodies, rather than a monotone, for alert signals.

As such, there remains a need for an improved buzzer assembly for use with portable communications devices that produces an acceptable level of audio volume across a broader frequency range, so as to be able to play melodies and the like for alert signals.

SUMMARY OF THE INVENTION

The buzzer assembly of the present invention includes a combined gasket and buzzer that change geometry and thereby change acoustic impedance at different audio frequencies. The change in acoustic impedance or acoustic load of the buzzer diaphragm changes the resonant frequency of the buzzer assembly. When the buzzer is then operated at or near resonant frequency corresponding to the then-current acoustic impedance, the sound generated by the buzzer assembly is louder. By changing the resonant frequency of the buzzer assembly in this manner to correspond to the frequency of the tone to be generated, the sound volume generated by the buzzer assembly can be augmented across a frequency range that may be 3 kHz or larger. When augmented in such a fashion, the audio output from the buzzer assembly is approximately constant across a larger frequency range than with conventional buzzer solutions, and preferably across the entire range frequency range of 1 kHz to 4 kHz.

One preferred embodiment of the buzzer assembly includes a conventional buzzer slidably mounted in a set of guide rails. A translational actuator, in this case a solenoid, is operatively connected to the buzzer so as to slide the buzzer within the guide rails. The output port of the buzzer is sealed against an expandable buzzer gasket which is also sealed against the output port of the communications device. By moving the buzzer with the solenoid, the volume of air within the expandable buzzer gasket changes, thereby changing the acoustic impedance seen by the buzzer. This change in acoustic impedance effectively changes the resonant frequency of the buzzer and allows different frequencies to be created by the buzzer assembly at comparable audio volume levels. The mechanical action of the solenoid is controlled by a suitable control circuit that interfaces with the balance of the personal communications device to cause the buzzer assembly to create alert signals that are melodies or the like, based on stored instructions. By dynamically changing the current acoustic impedance of the buzzer, and therefore the current resonant frequency of the buzzer, to correspond to the desired audio frequency, the buzzer assembly can create audio sounds of different frequencies at comparable volume levels. The buzzer assembly preferably outputs a relatively consistent volume across the frequency range of 1–4 kHz, thereby covering two octaves.

An alternative embodiment does not move the buzzer, but rather changes the volume of air within the gasket through the use of a variable geometry deformable gasket. The deformable gasket may include one or more piezo-electric films that change shape in response to various electrical currents. By changing the internal shape of the buzzer gasket, but keeping the buzzer stationary, the buzzer assembly may still change its resonant frequency by changing the acoustic impedance seen by the buzzer.

Another alternative embodiment uses a gasket of a fixed size, but includes an extra chamber acoustically communicating with the interior of the gasket. The volume of this extra chamber is changed by means of a translational actuator attached to a piston within the extra chamber. The change in volume of the extra chamber likewise changes the resonant frequency of the buzzer assembly and allows different frequencies to be created by the buzzer assembly at comparable volume levels.

Yet another embodiment uses a conventional gasket, but changes the size of the chamber within the buzzer itself, thereby changing the resonant frequency of the buzzer assembly.

DETAILED DESCRIPTION OF THE PREFERRED EMBODIMENT(S)

Figure 1:
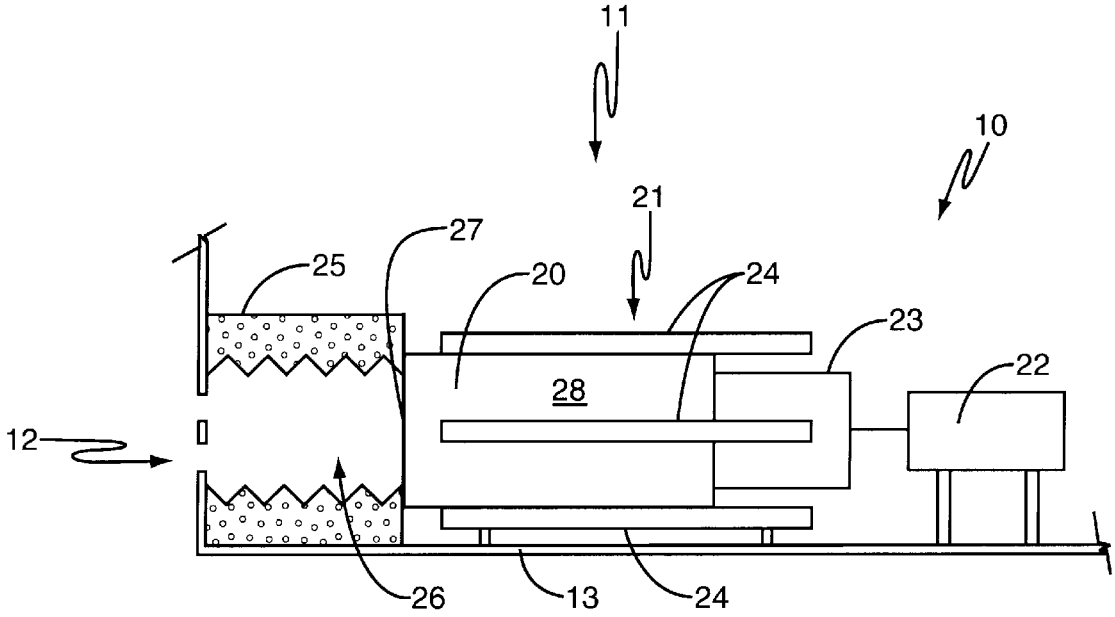
FIG. 1 shows a fragmented side view of the preferred embodiment of the present invention as seen in a communications device.
Figure 2:
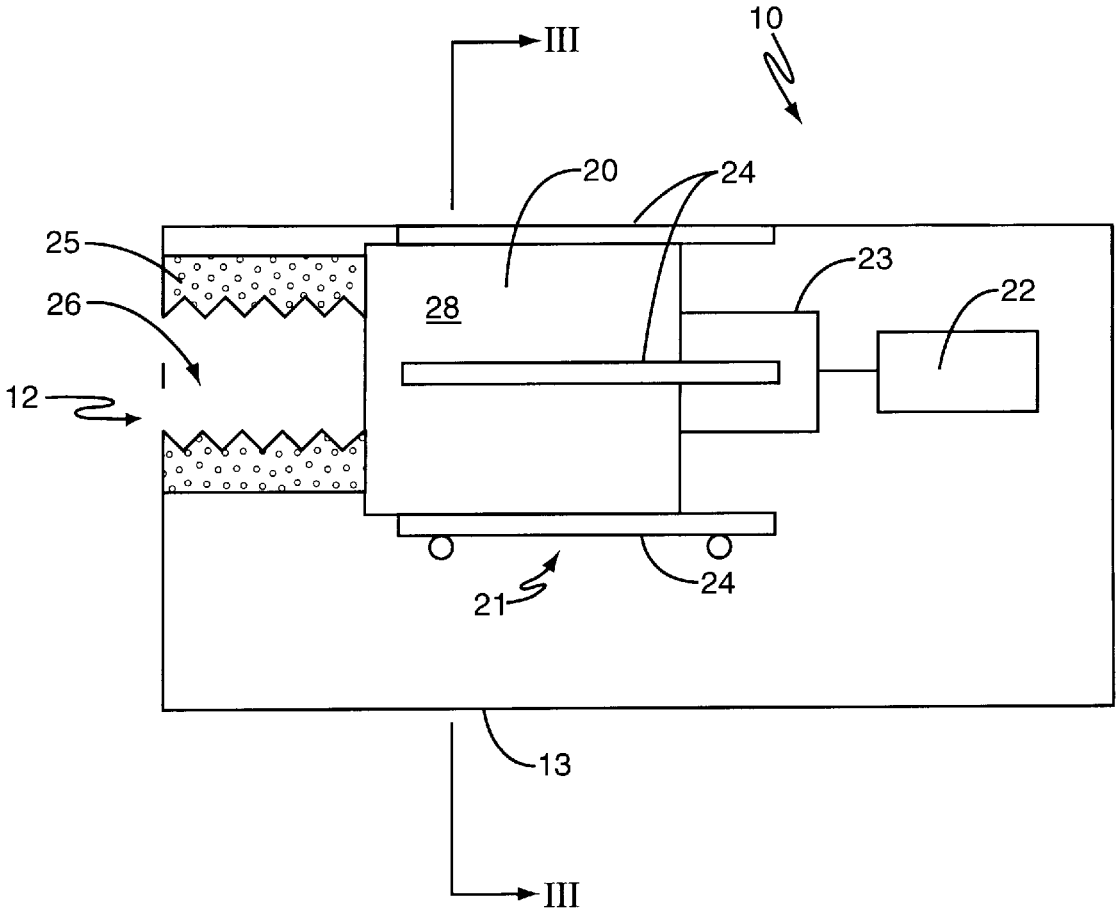
FIG. 2 depicts a top view of the device of FIG. 1.
Figure 3:
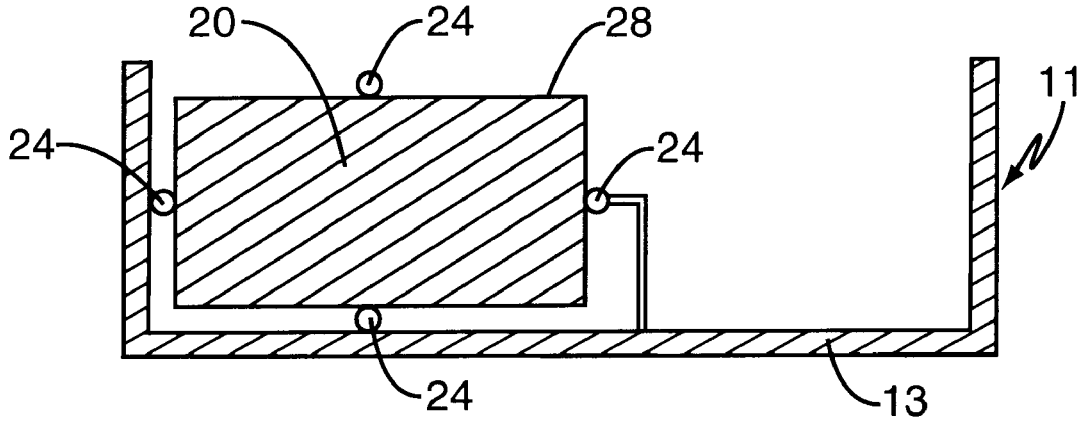
FIG. 3 illustrates a cross-sectional view along lines 3—3 of FIG. 2.

Turning now to the drawings, FIGS. 1–3 show one embodiment of a variable frequency buzzer assembly 10 of the present invention. The buzzer assembly 10 is positioned in a personal communications device 11, which may be a cellular telephone, satellite telephone, personal communications assistant, pager, or similar device. For simplicity of description, a cellular telephone will be used as the illustrative personal communications device 11 for the balance of this description; but it is to be understood that the invention is not limited thereby. Cellular telephone 11 includes a generally surrounding frame 13 which includes a call alert aperture 12. The call alert aperture 12 is typically proximate the antenna (not shown) and typically opens perpendicular to the plane of the phone's speaker (not shown) which conveys audio signals to the ear of the listener.

The buzzer assembly 10 includes a buzzer 20, a translational actuator 22, and a buzzer gasket 25. The buzzer 20 may be any one of a variety of conventional buzzers known in the art, such as part number EAF8RM08ER, from Matsushita Electronic Components Co., Ltd. of Matshusaka Mie, Japan. Typical buzzers 20 are approximately half the size of a postage stamp and approximately 2 mm to 5 mm thick; as a result, typical buzzers 20 are extremely light. Buzzer 20 includes a buzzer aperture 27 which permits passage of noise emitted within buzzer 20 into air chamber 26 within expandable gasket 25.

In a conventional cellular phone 11, the buzzer 20 is rigidly attached to the frame 13 of the phone 11 with a foam gasket positioned between the buzzer aperture 27 and the call alert aperture 12. During assembly, the gasket is attached at one end to the buzzer 20 by a conventional adhesive. When the frame 13 of the phone 11 is closed, the gasket is compressed to an initial degree, forming a seal with the buzzer 20 and the frame 13, thereby insuring that there is a fixed volume of air between the diaphragm of the buzzer 20 and the call alert aperture 12.

In contrast, the buzzer 20 of this embodiment is slidably positioned in guide track 21. Guide track 21 preferably includes four guide rails 24 (best seen in FIG. 3), one on each side of generally rectilinear buzzer 20. Translational actuator 22 moves buzzer 20 within guide track 21 by means of connector 23. In the preferred embodiment translational actuator 22 is a conventional electric solenoid that is capable of variable positioning. For some alternate embodiments, the translational actuator 22 may be a piezo-electric film (not shown) disposed generally perpendicular to the direction of travel for the buzzer 20. Since buzzer 20 is light weight, actuator 22 may be comparatively weak, thus keeping power requirements to a minimum and preventing undue power drain on the battery of the cellular phone 11.

Expandable gasket 25 forms a tight seal between frame 13 of the phone 11 and the body 28 of the buzzer 20. The seal need not be absolutely gas tight, but should be such as to significantly prevent the rapid flow of gas through the gasket, such that the gasket is effectively gas-tight for the changes in gas pressure expected in the typical acoustic range. Gasket 25 is preferably a closed cell foam gasket or an annular piece of preformed plastic with creases therein which expand and collapse like an accordion or bellows in response to the movement of buzzer 20. The interior portion of the gasket 25, between the frame 13 and the buzzer 20 forms a portion of air chamber 26. Air chamber 26 also includes the chamber portion on the inside of the body 28 of the buzzer 20 with buzzer aperture 27 linking the two portions of the air chamber 26 in this embodiment. The portion of the frame 13 bounding air chamber 26 should include the call alert aperture 12. In contrast to the conventional gasket described above, gasket 25 is initially compressed to a first degree during assembly, but then also further compresses and decompresses as the buzzer 20 slides within guide track 21. Expandable gasket 25 changes shape, and thus changes the volume of air chamber 26, in response to the translation of buzzer 20 within guide track 21.

Air chamber 26 presents a specific acoustic loading to the sound generating diaphragm inside the body 28 of the buzzer 20. The magnitude of the loading is partially a function of the volume of air in the air chamber 26. This acoustic loading, or impedance, in turn determines the resonant frequency of the buzzer assembly 10. By changing the volume of air chamber 26, the acoustic impedance is changed, thereby creating a different resonant frequency of the buzzer assembly 10. By operating the buzzer 20 at or near the resonant frequency corresponding to the current acoustic impedance, the buzzer assembly 10 can create audio sounds of different frequencies at comparable volume levels.

The mechanical action of the translational actuator 22, and thus the acoustic impedance of air chamber 26, is controlled by a suitable control circuit that coordinates the action of translational actuator 22 with the desired frequency to be produced by the buzzer 20 as described below. While the buzzer assembly 10 preferably outputs a relatively consistent volume across the frequency range of 1–4 kHz, thereby covering two octaves, the buzzer assembly 10 may provide a relatively consistent volume across the larger frequency range of 1–4.5 kHz.

Figure 4:
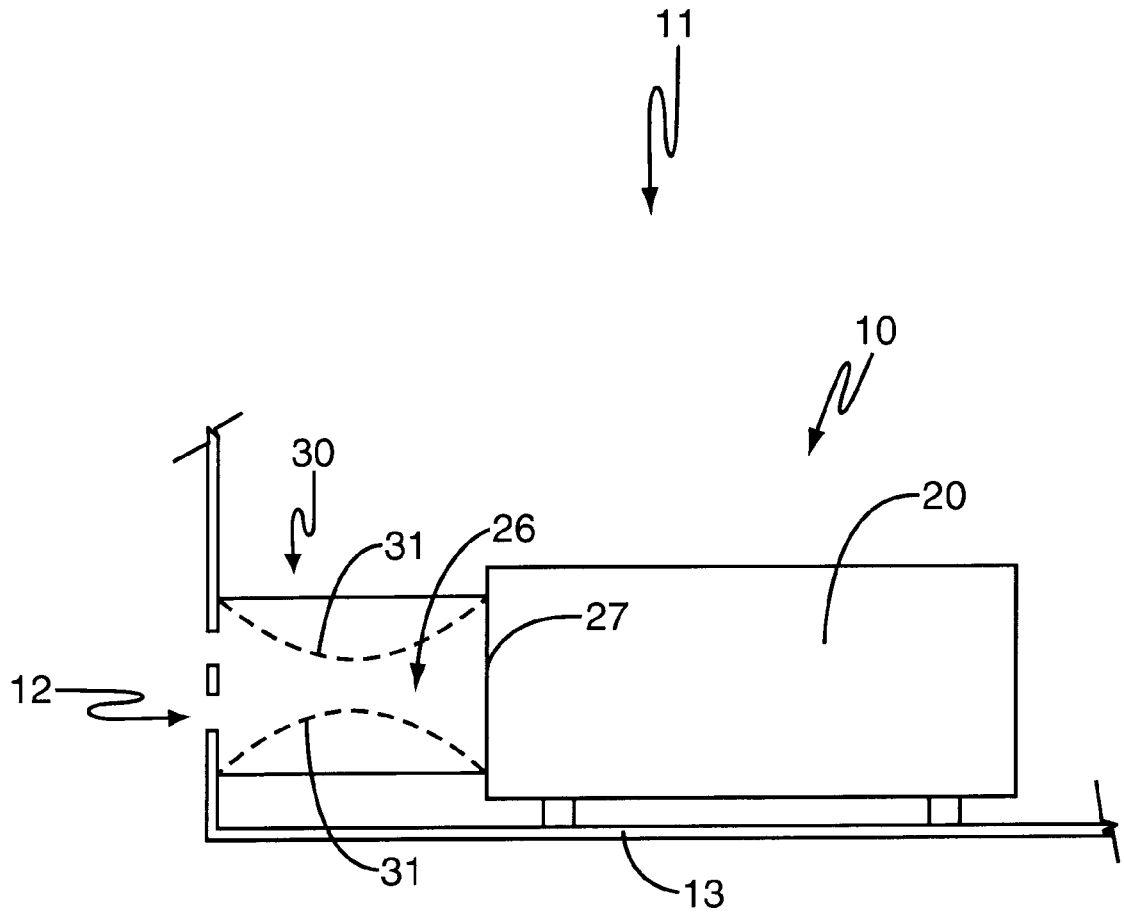
FIG. 4 features a side view of a second embodiment of the present invention as seen in a fragmented communications device.

An alternative embodiment of the buzzer assembly 10 is seen in FIG. 4. In this embodiment the buzzer 20 is attached to deformable gasket 30 that changes shape without requiring the buzzer 20 to be displaced. This embodiment replaces gasket 25 with deformable gasket 30 that may include at least one piezo-electric film 31, and preferably two films 31, which deform upon application of electrical current thereto. Gasket 30 must still maintain an effective seal between buzzer aperture 27 and frame 13 of phone 11; thus, films 31 may be optionally contained within a closed cell foam gasket or the like. When films 31 deform upon application of current thereto, the volume within air chamber 26 changes to change the resonant frequency of buzzer 20 as discussed above. For purposes herein, the film(s) 31 are considered translational actuators.

Figure 5:
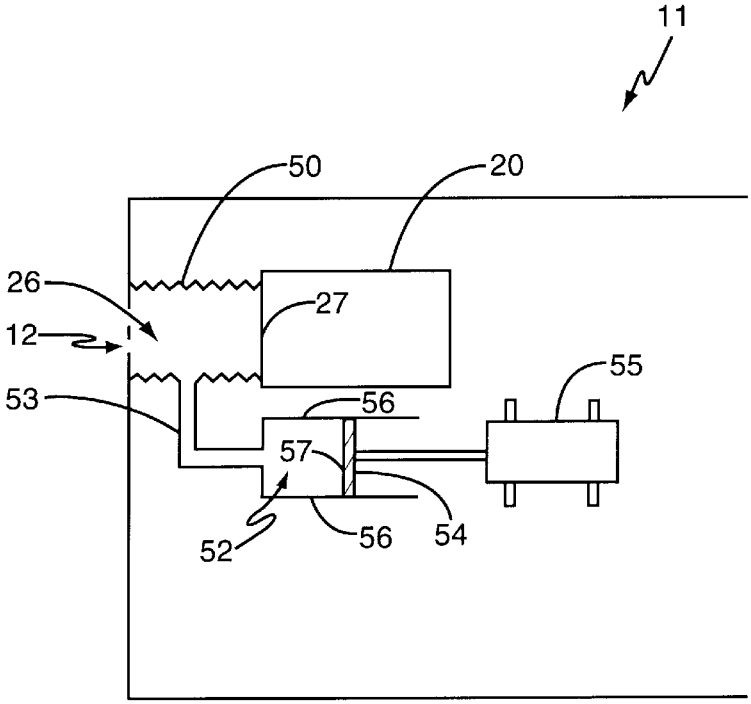
FIG. 5 pictures a top view of a third embodiment of the present invention as seen in a fragmented communications device.
Figure 5A:
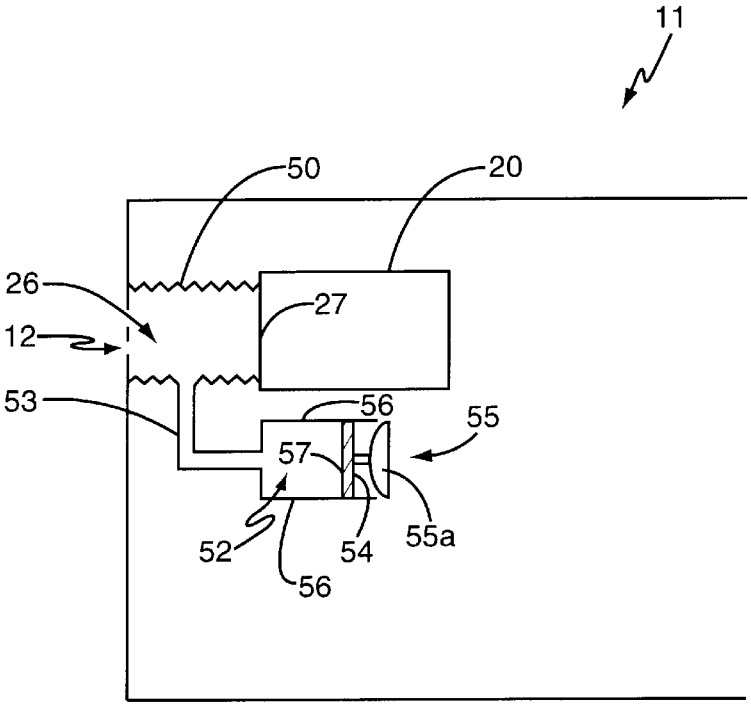
FIG. 5A shows a top view of an alternative embodiment of FIG. 5 using a piezo-electric translational actuator.

Another embodiment of the buzzer assembly 10 is shown in FIG. 5. In this embodiment, air chamber 26 is changed to further include a variable-sized second chamber 52 that helps regulate the acoustic impedance of air chamber 26 encountered by the buzzer 20. This second chamber 52 is substantially external to gasket 50 as shown in FIG. 5, but is fluidly connected to the chamber formed by the interior of gasket 50 by neck 53. The volume of air within second chamber 52 is varied by piston 54 driven by translational actuator 55. Since gasket 50 should be gas tight, piston 54 should have a good seal with walls 56 of second chamber 52. This may be accomplished with an o-ring (not shown) positioned around piston head 57 or other similar sealing means. Translational actuator 55 is preferably a solenoid, but may be a piezo-electric device 55*a* (see FIG. 5A) hydraulic, pneumatic device, or similar device, which linearly drives piston 54. Neck 53 may be of any suitable size, but preferably the neck 53 is not a quarter wavelength of any desired frequency to prevent the formation of standing waves therein. Alternatively, the neck 53 may be sized so as to resonate at the highest desired frequency when the second chamber 52 is at a minimum (e.g., piston 54 is fully extended). Movement of piston 54 within second chamber 52 changes the oscillating characteristics of the air in neck 53 and thus the resonant frequency of buzzer assembly 10, in a fashion approximating a Helmholtz resonator. The air in the neck 53 will oscillate at a frequency dependant on the volumes at either end of the neck 53. Thus, the oscillation in the neck 53 may be tuned by varying the volumes of the air chamber 26 and/or the second chamber 52.

Figure 6:
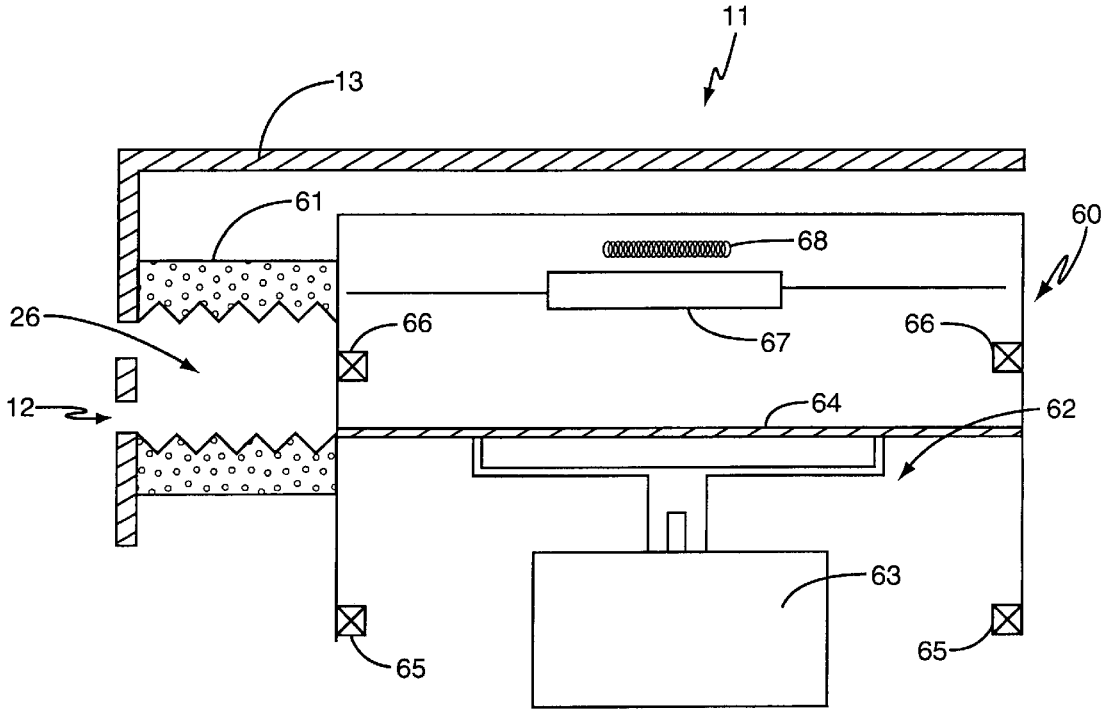
FIG. 6 demonstrates a top view of a fourth embodiment of the present invention as seen in a fragmented communications device.
Figure 6A:
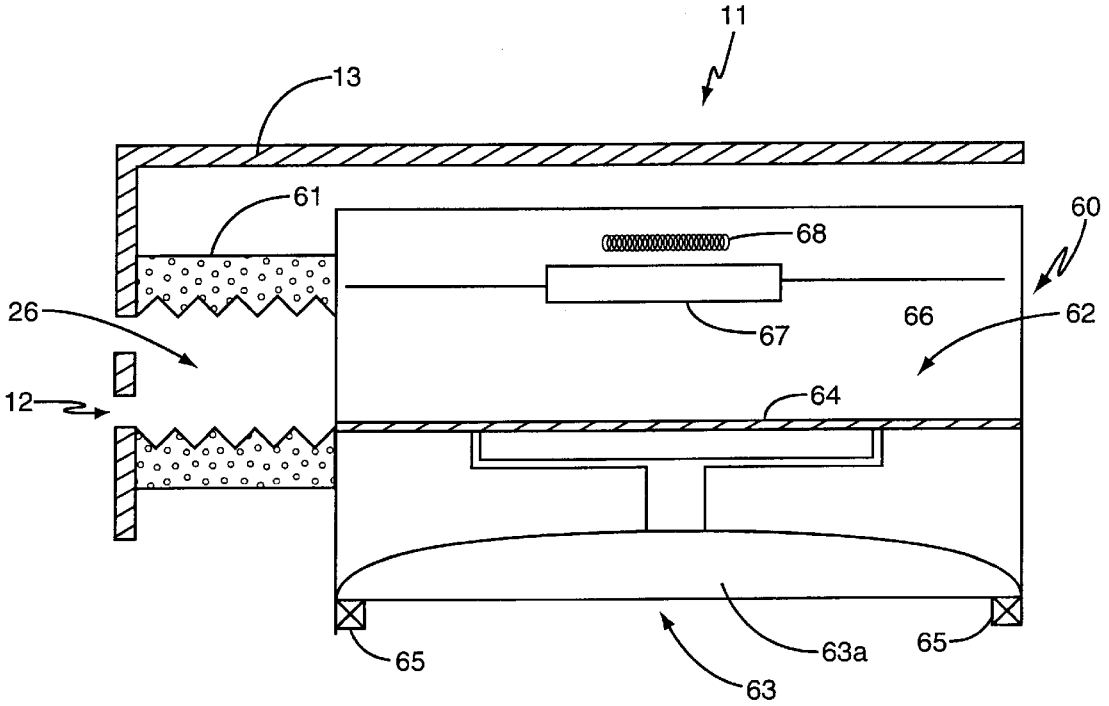
FIG. 6A shows a top view of an alterntive embodiment of FIG. 6 using a piezo-electric translational actuator.

Another embodiment of buzzer assembly 10 is shown in FIG. 6, wherein air chamber 26 is defined by gasket 61 that is constant in size and variably sized chamber 62 in buzzer 60. In this embodiment, translational actuator 63 drives piston 64, which travels between stops 65 and 66. Movement of piston 64 changes the volume of air in chamber 62 within the body of buzzer 60, thereby creating different resonant frequencies for buzzer diaphragm 67 and coil 68. Translational actuator 63 again may be a solenoid, piezo-electric device 63*a* (see FIG. 6A ) pneumatic, hydraulic or other similar device as desired, although a solenoid is preferred.

Figure 7:
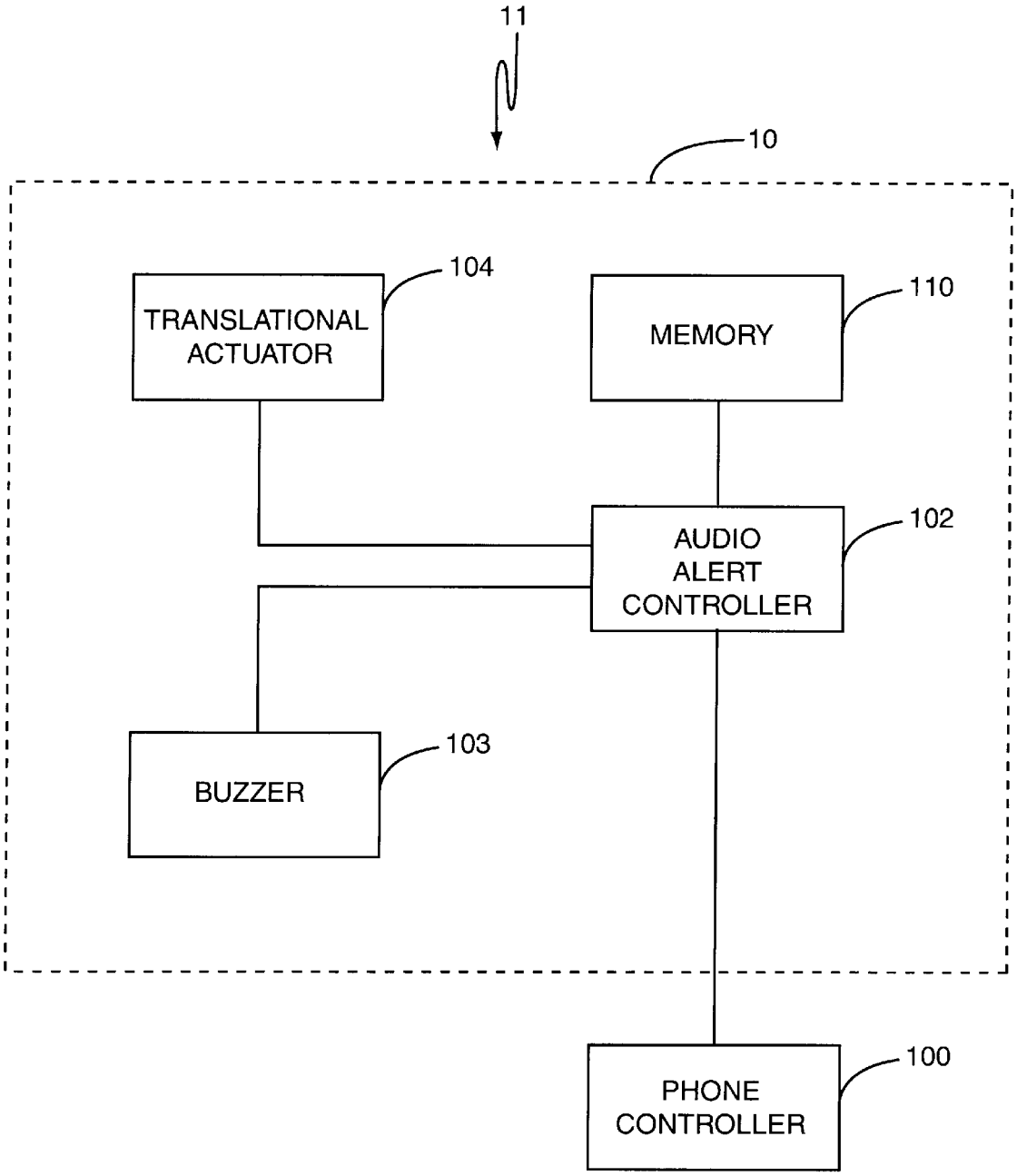
FIG. 7 shows a block diagram of the electrical control circuitry of the present invention.

For proper functioning of the various embodiments of the buzzer assembly 10, the translational actuators need to be controlled. A control circuit, such as that seen in FIG. 7, may be incorporated into cellular phone 11 for such purposes. The control circuit of FIG. 7 includes an audio alert controller 102 connected to phone controller 100, translational actuator 104, and preferably buzzer 103. The phone controller 100 controls the overall operation of the phone 11 in a manner known in the art. The phone controller 100 may be of any type known in the art, such as a common microprocessor. Audio alert controller 102 controls the movement of translational actuator 104 so that movements of translational actuator 104 are synchronized to desired changes in ring frequency of buzzer 103. While the audio alert controller 102 may be a portion of the phone controller 100, the audio alert controller 102 is shown separate therefrom for illustrative purposes and preferably takes the form of a mixed signal ASIC chipset. Buzzer 103 may be buzzer 20 or buzzer 60, depending on the embodiment and translational actuator 104 may be actuator 22, piezo-electric films 31, actuator 55 or actuator 63, again depending on the embodiment. In the first embodiment, wherein buzzer 103 is buzzer 20 and moves, electrical connections to buzzer 20 are preferably short wires or flex film connections, which allow buzzer 20 to move on guide track 21 (FIGS. 1–3). As discussed in regards to the second described embodiment, films 31 are considered translational actuators because while integrated within gasket 30, films 31 perform the physical movement through their deformation, which actuates the change in volume of the interior of gasket 30. If, as in the second, third, and fourth described embodiments, the buzzer (20 or 60) remains stationary with respect to the frame 13 of the phone 11, the buzzer 20,60 may be connected to the control circuit in any conventional fashion, such as by printed circuit board traces.

The audio alert controller 102, activates the buzzer assembly 10 to generate an audio alert signal to the user. For instance, the alert controller 102 may receive a trigger signal from phone controller 100 when an incoming call is detected. Preferably, the phone controller 100 also notifies the audio alert controller 102 which may use a plurality of "alert sounds" stored in memory 110. The audio alert controller 102 then retrieves sound generating information from memory 110, and activates the buzzer 103 and the translational actuator 104. The sound generating information preferably includes either movement instructions or frequency information from which movement instructions may be determined. The translational actuator 104 is then moved in such a fashion as to cause the buzzer assembly 10 to generate the desired alert sound. For instance, if the desired alert sound is a melody, the translational actuator 104 would be sequentially moved to the proper position for each note, so that the resonant frequency of the buzzer assembly 10 is adjusted to the frequency of that note for the appropriate time. Then the translational actuator 104 is moved to the position corresponding to the next note, and so forth.

By changing the resonant frequency of the buzzer assembly 10, the volume of the output of the buzzer assembly 10 through the call alert aperture 12 may be held relatively constant across a variety of frequencies.

It should be noted that the various alert sounds stored in memory 110 may be predetermined by the phone's manufacturer, or the phone may allow the user to establish their own alert sounds by any method known in the art.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A variable frequency buzzer assembly, comprising:

a) a buzzer and a gasket contiguous to said buzzer, said gasket and said buzzer together defining an air space that acts as an acoustic impedance to sounds generated by said buzzer; and b) an acoustic outlet coupled to said gasket for outputting sounds from said buzzer via said gasket;

c) a translational actuator operative to move from a first position to at least a second position and thereby change said acoustic impedance by changing the physical configuration of said air space; and d) wherein the audio volume of the sound generated by the buzzer assembly at said acoustic outlet is substantially uniform across a frequency range from a first frequency to a second frequency.

2. The buzzer assembly of claim 1 wherein said translational actuator includes a solenoid.

3. The buzzer assembly of claim 2 wherein said solenoid is mechanically coupled to said buzzer.

4. The buzzer assembly of claim 2 wherein said air space includes a first and second chamber sonically coupled to one another and wherein said solenoid is mechanically coupled to said second chamber.

5. The buzzer assembly of claim 1 further comprising a track guides, said buzzer slidably positioned in said track guide and said translational actuator moving said buzzer along said track guide to compress and expand said gasket.

6. The buzzer assembly of claim 1 wherein said translational actuator includes at least one piezo-electric film.

7. The buzzer system of claim 6 wherein said piezo-electrical film forms at least a portion of said gasket.

8. The buzzer system of claim 1 wherein said gasket comprises a first and second chamber and wherein said translational actuator includes a piston movably positioned in said second chamber.

9. The buzzer system of claim 1 wherein said gasket comprises a first and second chamber and wherein said translational actuator includes at least one piezo-electric film movably positioned in said second chamber.

10. The buzzer system of claim 1 wherein said buzzer includes a body and said translational actuator comprises a piston movably positioned in said body.

11. The buzzer system of claim 1 wherein said buzzer includes a body and said translational actuator comprises at least one piezo-electric film movably positioned in said body.

12. The buzzer assembly of claim 1 wherein both said first and second frequencies are at least 1 kHz and separated by more than 200 Hz.

13. A method of varying the audio characteristics of an alert signal for a personal communications device, said personal communications device having associated therewith a buzzer assembly having a resonant frequency variable between at least a first resonant frequency and a second resonant frequency, comprising:

a) driving a buzzer diaphragm of said buzzer assembly at a first frequency corresponding to said first resonant frequency of the buzzer assembly; and b) immediately thereafter, moving a translational actuator to change the resonant frequency of said buzzer assembly to said second resonant frequency and driving said diaphragm of said buzzer at a second frequency corresponding to said second resonant frequency; and c) wherein the sound generated by said buzzer assembly at said first frequency is approximately equal in volume to the sound generated by said buzzer assembly at said second frequency.

14. The method of claim 13 wherein said translational actuator is operative to change the acoustic impedance of said buzzer assembly so that the sound generated by said buzzer assembly is approximately equal in volume across the frequency range from said first frequency to said second frequency.

15. The method of claim 13 wherein said first frequency is approximately 1 kHz and said second frequency is approximately 4.5 kHz.

16. The method of claim 13 wherein said first frequency is approximately 1 kHz and said second frequency is approximately 4 kHz.

17. The method of claim 13 wherein said buzzer assembly includes a buzzer that includes said buzzer diaphragm and a gasket disposed proximate to said buzzer and defining a gasket chamber such that sound from said buzzer flows through said gasket chamber before exiting said buzzer assembly.

18. The method of claim 17 wherein moving a translational actuator to change the acoustic impedance of said buzzer assembly comprises the step of using a solenoid to move said buzzer to compress and expand said gasket and thereby change the physical configuration of said gasket chamber.

19. The method of claim 18 wherein using a solenoid to move the buzzer to compress and expand the gasket comprises the step of moving the buzzer on a guide track.

20. The method of claim 17 wherein said gasket chamber is bounded by at least one piezo-electric film and wherein moving a translational actuator to change the acoustic impedance of said buzzer assembly includes changing the geometry of the gasket chamber by deforming said piezo-electric film.

21. The method of claim 17 wherein moving a translational actuator to change the acoustic impedance of said buzzer assembly includes the step of moving a piston within the body of the buzzer to change the volume of air contained within the buzzer.

22. The method of claim 17 further including a second chamber sonically coupled to said gasket chamber and wherein moving a translational actuator to change the acoustic impedance of said buzzer assembly includes the step of moving a piston within said second chamber to change the volume of air within said second chamber.

23. The method of claim 13 wherein said second frequency corresponding to said second resonant frequency is within 10 percent of said second resonuant frequency.

24. A personal communications device, comprising:

a) a buzzer assembly having:

i) a buzzer and a gasket contiguous to said buzzer, said gasket and said buzzer together defining an air space that acts as an acoustic impedance to sounds generated by said buzzer;

(ii) an acoustic outlet coupled to said gasket for outputting sounds from said buzzer via said gasket;

(iii) a translational actuator including a solenoid mechanically coupled to said buzzer and operative to move from a first position to at least a second position and thereby change said acoustic impedance by changing the physical configuration of said air space;

(iv) wherein the audio volume of the sound generated by the buzzer assembly at said acoustic outlet is substantially uniform across a frequency range from a first frequency to a second frequency;

(b) memory having at least one multi-frequency audio alert stored therein, said audio alert having at least two frequencies that are at least 200 Hz apart; and (c) control circuitry in communication with said memory and said buzzer assembly and operative to control the movement of said translational actuator and thereby control the sound generated by said buzzer assembly in accordance with said audio alert.

* * * * *